United States Patent [19]

Wey et al.

[11] Patent Number: 5,022,596

[45] Date of Patent: Jun. 11, 1991

[54] METHOD AND APPARATUS FOR DETECTING THE FEED PROPERTIES OF FEED BOBBINS

[75] Inventors: Edmund Wey, Nettetal; Hans Grecksch, Monchen-Gladbach; Albert T. Pesch, Monchen-Gladbach; Herbert Knors, Monchen-Gladbach; Wilhelm Zitzen, Monchen-Gladbach; Manfred Marquardt, Duisburg-Hamborn, all of Fed. Rep. of Germany

[73] Assignee: W. Schlafhorst AG & Co., Mönchengladbach, Fed. Rep. of Germany

[21] Appl. No.: 455,492

[22] Filed: Dec. 18, 1989

[30] Foreign Application Priority Data

Dec. 16, 1988 [DE] Fed. Rep. of Germany ..... 3842381

[51] Int. Cl.[5] ..... B65H 63/00; B65H 54/22

[52] U.S. Cl. ..... 242/36; 242/35.6

[58] Field of Search ..... 242/36, 35.6 R, 35.5 R, 242/35.5 A, 18 R, 37 R

[56] References Cited

U.S. PATENT DOCUMENTS

| | | | |
|---|---|---|---|
| 2,736,505 | 2/1956 | Furst et al. | 242/36 |
| 2,752,103 | 6/1956 | Furst | 242/36 |
| 2,752,104 | 6/1956 | Furst | 242/36 |
| 4,513,921 | 4/1985 | Imoda et al. | 242/36 |
| 4,804,151 | 2/1989 | Kathke | 242/36 X |
| 4,854,515 | 8/1989 | Tone | 242/36 |

*Primary Examiner*—Stanley N. Gilreath

*Attorney, Agent, or Firm*—Herbert L. Lerner; Laurence A. Greenberg

[57] ABSTRACT

A method and winding apparatus for detecting feed bobbins having feed properties that do not correspond to a predetermined quality when winding feed bobbins onto cross-wound bobbins in an automatic bobbin winding machine is disclosed. The method comprises the steps of measuring the winding speed, counting yarn breaks before a predetermined threshold speed is reached for forming a yarn break count, detecting the quality of a given feed bobbin by comparing the yarn break count with a predetermined number and determining that the given feed bobbin has not attained a predetermined quality if the yarn break count reaches the predetermined number; if the quality is not attained, the given feed bobbin is rejected and the winding process is continued with a new feed bobbin.

9 Claims, 2 Drawing Sheets

METHOD AND APPARATUS FOR DETECTING THE FEED PROPERTIES OF FEED BOBBINS

Figure 1:
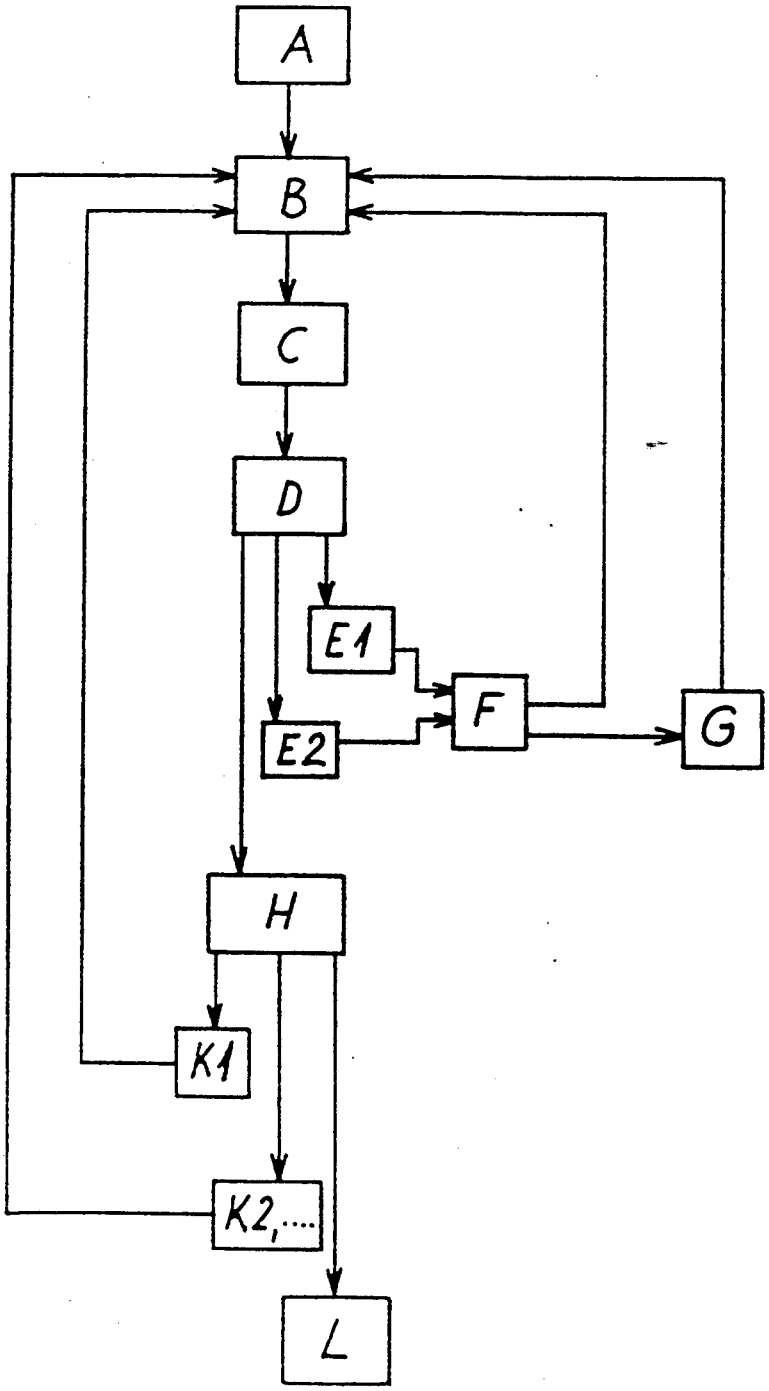

The invention relates to a method and winding apparatus for detecting feed bobbins having feed properties which do not meet or correspond with a predeterminable quality, when winding feed bobbins onto cross-wound bobbins in an automatic bobbin winding machine.

When rewinding feed bobbins onto cross-wound bobbins or cheeses at automatic bobbin winding machines, problems can increasingly arise when the last layers of yarn on the tubes are unwound. If the new yarn is tied-in by hand, especially after a change of yarn type or color on a ring spinning machine, the feed bobbins typically unwind more poorly at the end of the bobbin trip or travel than do the subsequent feed spools that are automatically changed and tied-in. The result can be increased yarn breakage at the same winding station. If the yarn breaks are successive, the final result is called a "red-light condition", which means that the winding station is shut down and can only be put back into operation after suitable maintenance by a maintenance worker.

A feed bobbin with poor feed properties causes a loss in production at the applicable winding station, reduced yarn quantity, and in the case of yarn joining devices that are not stationary, it causes a blockage of the device because yarn joins at the same winding station are repeatedly required.

It is accordingly an object of the invention to provide a method and apparatus for detecting the feed properties of feed bobbins that do not meet a predetermined quality and for replacing them, which overcome the hereinafore-mentioned disadvantages of the heretofore-known methods and devices of this general type.

With the foregoing and other objects in view there is provided, in accordance with the invention, a method for detecting feed or delivery bobbins having feed properties that do not meet or correspond to a predetermined quality when winding feed bobbins onto cross-wound bobbins in an automatic bobbin winding machine, which comprises measuring the winding speed, detecting the quality of a given feed bobbin by utilizing a yarn break in relation to the winding speed, and rejecting the given feed bobbin and continuing the winding process with a new feed bobbin if a predetermined quality is not attained.

Yarn breaks in the last phase of unwinding the feed bobbin often occur immediately after the yarn join has been made, at a winding speed that is below the set-point or nominal speed. Accordingly, the problem is that several yarn breaks can occur in succession in the same feed bobbin shortly before a bobbin is finished. Although the yarn joins can be redone, the related problems cause increased tension on breaks in the lower range of the winding speed while running up to the set-point speed of the winding station.

The method according to the invention provides for measuring the winding speed at the winding station and for utilizing a yarn break in relation to the winding speed to recognize the quality of the feed bobbins. If the predetermined quality is not attained, then the applicable feed bobbin is rejected, and the winding operation is continued with a new feed bobbin.

German Published, Non-Prosecuted Application DE-OS 37 18 924 discloses an automatic bobbin winding machine with a plurality of winding stations, in which a tension sensor is provided at each winding station to detect the tension or tensile force of the traveling yarn in the yarn drive mechanism. The tension sensor is located between a spinning bobbin on the yarn supply side and a take-up bobbin on the yarn take-up side. That tension sensor is intended to prevent excessively high tensile stress in the yarn drawn from a spinning bobbin. If an increase in the yarn tension is recorded by the tension sensor, then a cutting device is actuated to sever the yarn, or as another alternative, the drive motor of the roller of the yarn guide or jig motion device is stopped. Subsequently, the yarn must be rejoined or spliced once the malfunction has been taken care of.

The known method is intended to aid in avoiding such yarn breaks, but the quality of the feed bobbin properties is not monitored, so that in the final analysis those feed bobbins that exhibit disproportionate yarn breakage or disproportionately frequent peaks in yarn tension are not replaced by a new feed bobbin, and thus, despite the provisions made, they continue to present a considerable hindrance to proper winding operation of the winding station.

In accordance with another mode of the invention, there is provided a method which comprises restarting the winding process with the given feed bobbin before carrying out the step of rejecting the feed bobbin, and rejecting the feed bobbin only if the predetermined quality is not attained after a plurality of restarting steps.

In accordance with a further mode of the invention, there is provided a method which comprises utilizing the occurrence of multiple yarn breaks at a winding speed below a predetermined threshold speed, as an evaluation signal.

In the method according to the invention, once a yarn join has been successfully made, the winding station is put into operation. The presence of the yarn is checked with a yarn monitor that functions as a signal transmitter or transducer for a yarn break. At the same time, a sensor for detecting the winding speed is activated. The winding speed is compared with a threshold speed value previously fed to a signal process apparatus. If a yarn break occurs below the predetermined threshold speed value, this yarn break is counted. Either the feed bobbin changer then changes the feed bobbin immediately, or a new yarn join may be made.

If yarn breaks subsequently occur in an uninterrupted succession until a predetermined number has been reached, and they all occur before the threshold speed value is attained, then the feed bobbin is changed.

If the winding speed exceeds the predetermined threshold speed value without any further yarn breakage, then the feed properties of the feed bobbin do meet the predetermined quality. A yarn break occurring above this threshold speed value is no longer used as a criterion for the quality of the feed properties. The counter that counts the number of yarn breaks and compares it with the predetermined, tolerable number of such breaks, is set to zero.

The threshold speed value should be set in such a way that a stable winding operation prevails even in the phase before operating speed is reached. Therefore, in accordance with an added mode of the invention, there is provided a method which comprises setting the threshold speed to a value below a normal winding speed at which a stable winding operation occurs.

In accordance with an additional mode of the invention, there is provided a method which comprises predetermining the threshold speed as a function of yarn parameters, such as the yarn material or the yarn count. The threshold speed can thus be optimally set for the yarn properties.

With the objects of the invention in view, there is also provided a winding apparatus for detecting feed or delivery bobbins having feed properties that do not correspond to a predetermined quality when winding feed bobbins onto cross-wound bobbins in automatic bobbin winding machine, comprising feed bobbin changer, a sensor for detecting winding speed and issuing a winding speed signal, a yarn monitor and transducer or transmitter for ascertaining a yarn break and issuing a yarn break signal, and a signal processing apparatus connected to the yarn monitor for receiving the yarn break signal and connected to the sensor for receiving the winding speed signal and ascertaining the winding speed signal at speeds up to a predetermined winding speed, the signal processing apparatus being connected to the feed bobbin changer for generating and feeding a signal to the feed bobbin changer to change the feed bobbin whenever the yarn break signal and the winding speed signal at speeds up to the predetermined winding speed are present at the same time.

The advantage of the method and apparatus according to the invention is that feed bobbins having feed properties which do not meet a predetermined quality criterion are recognized early and replaced. This avoids an unnecessarily long blockage of winding stations, and therefore leads to an increase in productivity of the winding stations and to a lower rate of flaws in the yarn.

Other features which are considered as characteristic for the invention are set forth in the appended claims.

Although the invention is illustrated and described herein as embodied in a method and apparatus for detecting the feed properties of feed bobbins, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
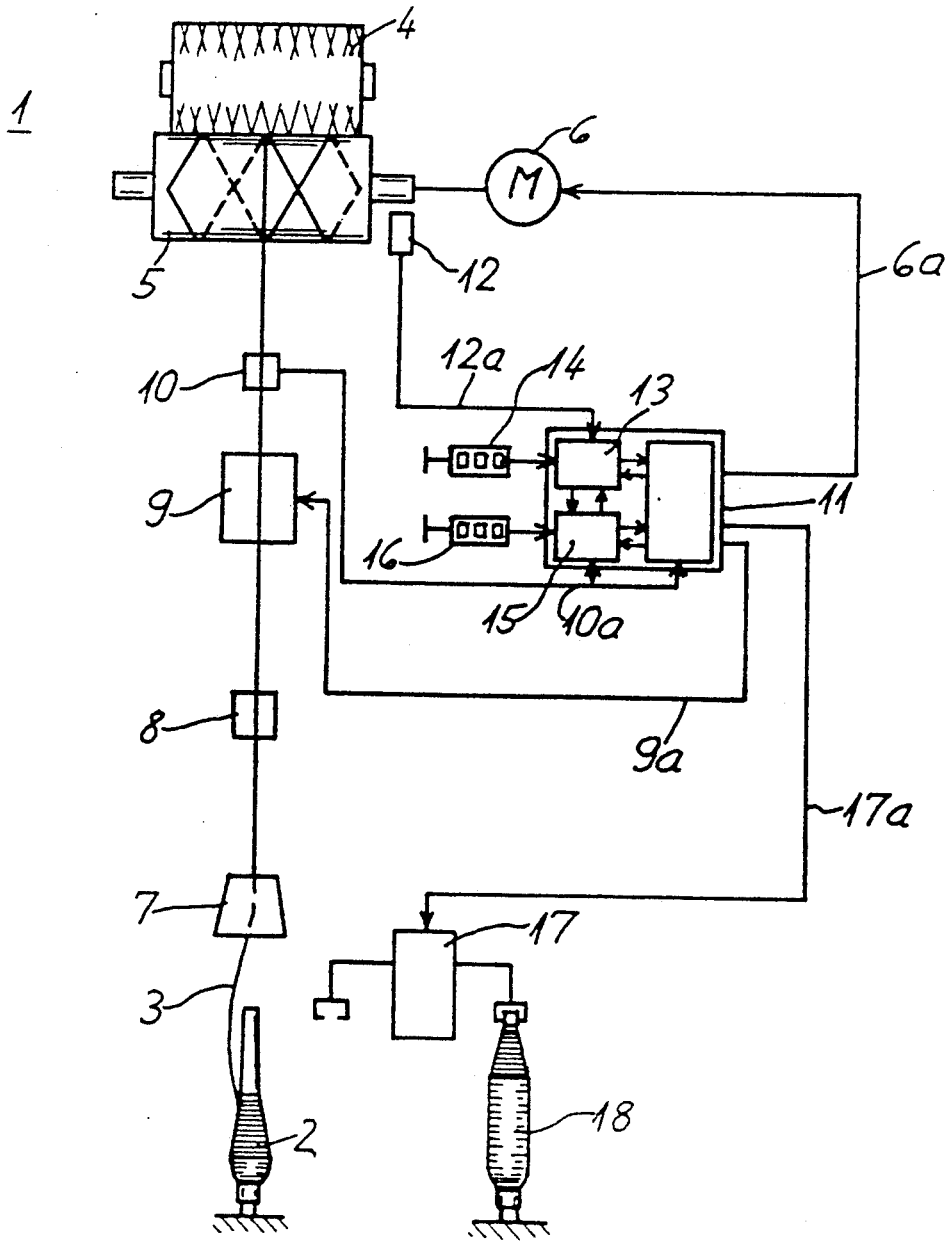

FIG. 1 is a flow chart illustrating an exemplary embodiment of the method according to the invention; and FIG. 2 is a diagrammatic and schematic view of an automatic bobbin bobbin machine for carrying out the method.

Referring now to the figures of the drawing in detail and first, particularly, to FIG. 1 thereof, it is seen that if a bobbin winding apparatus is running at a normal winding speed and a yarn break A occurs, then a yarn join B is first made. The restored yarn s then transferred to the winding apparatus. Next, the winding station is put into operation at C.

A sensor detects the winding speed of the winding drum as it runs up to operating speed. This is indicated on the flow chart at D. If a first yarn break E1 then occurs before a predetermined threshold speed value H of the winding speed is attained, then an inquiry F is made as to whether the number of permitted yarn breaks below the predetermined threshold speed value has already been reached. If not, then a new yarn join is made. Accordingly, method steps B, C, D then ensue once again.

In this exemplary embodiment of the method according to the invention, the permitted number of yarn breaks below the predetermined threshold speed value is to be limited to two. After the first yarn break below the predetermined threshold speed value for the winding speed, a yarn join is accordingly made. If a second yarn break E2 then occurs before the predetermined threshold speed value is attained, an inquiry F is again made as to whether the number of permitted yarn breaks has already been reached. In the present example, this number is already reached when two yarn breakages occur, so that a change of the feed bobbin is performed at G. After the feed bobbin is changed, the yarn join to the cheese is made, and the winding station is put back into operation. Proper unwinding at L, then ensues.

In the present exemplary embodiment of the method, if a yarn join is made after the first yarn break prior to attainment of the predetermined threshold spaced value H for the winding speed, and thereupon the predetermined threshold winding speed is exceeded, the ensuing break K1 will not lead to an inquiry F about the permitted yarn breaks. In this case, a yarn join is immediately made, in accordance with step B. In all of the ensuing yarn breaks K2, etc. that occur above the predetermined threshold speed value, these yarn breaks are again not used as a criterion for the feed properties of the feed bobbin. If no yarn break occurs, then proper unwinding at L, takes place.

FIG. 2 shows an exemplary embodiment of the apparatus according to the invention for performing the method of the invention.

The embodiment example diagrammatically and schematically shows a winding apparatus 1 in an automatic bobbin winding machine. Yarn 3 runs from a feed bobbin 2 onto a take-up bobbin 4, which is wound as a cross-wound bobbin or cheese and rests on a take-up or winding roller 5. The take-up or winding roller 5 is driven by a drive motor 6 and is constructed as a grooved drum, so that it simultaneously performs yarn guidance. The yarn travels over the grooved drum 5 onto the cheese 4 through a balloon breaker 7, a yarn tensioner 8 acting as a tension regulator, and a yarn monitor 10 that functions as a signal transducer for yarn breaks.

A yarn joining or connecting device 9 which is also provided, may be installed either stationarily on the winding apparatus 1 or on a non-illustrated mobile servicing device, by means of which it is moved to the applicable winding station to repair a yarn break as needed.

The winding apparatus 1 has a signal processing apparatus 11 that simultaneously operates as a control device. In the exemplary embodiment, a sensor 12 is installed at the winding roller 5 in order to ascertain the winding speed. The sensor 12 communicates through a signal line **12*a* with a signal transmitter or transducer 13 that is integrated into the signal processing apparatus 11. The yarn monitor 10 communicates through a signal line 10*a* with a counter 15 for the yarn breaks and with the signal processing apparatus 11. The signal transmitter 13 is preceded by a threshold speed value setter 14. The threshold speed value can be set individually at the threshold speed value setter 14** as a function of the yarn parameters, such as the material and the yarn count or size of the yarn. The winding operation should already be stable at this winding speed At a typical winding speed of approximately 300 m/min, a threshold speed value of approximately 100 m/min has been found advantageous. This is approximately 30% of the typical winding speed. At different winding speeds, the threshold speed value may be correspondingly above or below this value.

The counter 15 for yarn breaks is preceded by a yarn break signal setter 16, at which the number of permitted yarn breaks below the threshold speed value can be set.

If the winding apparatus is operating at the intended winding speed, i.e., its set-point or nominal speed, and a yarn break occurs, this is recorded by the signal transmitter 10 for the yarn break. A signal travels over the signal line 10*a* to the yarn break counter 15 and to the signal processing apparatus 11.

Since the set-point speed prevails at the winding apparatus, the yarn break is not recorded by the counter 15. In contrast, the signal processing apparatus 1 emits a signal over the signal line 6*a* in order to stop the drive motor 6 of the grooved drum or winding roller 5. At the same time, a signal is emitted over the signal line 9*a* to the yarn joining device 9 to make a yarn join. Once the yarn join has been made, a signal is given to the drive motor 6 to the start up again. The yarn monitor 10 and the sensor 12 for detecting the winding speed are activated and communicate with the signal processing apparatus 11. The winding speed is compared continuously with the predetermined threshold speed value. If the threshold is exceeded and no yarn break has occurred until then, then proper unwinding of the feed bobbin occurs. The feed properties of the feed bobbin are in accord with the predetermined quality.

However, if the yarn monitor 10 records a yarn break before the winding speed set at the threshold speed value setter 14 is reached, then the drive motor 6 is stopped by the signal processing apparatus 11 on the basis of a yarn brake signal emitted by the yarn monitor 10 at the same time, a comparison of the number of yarn breaks with the allowed number of yarn breaks predetermined by the yarn break signal setter 16 is made.

If this number is not attained, then a signal to make a yarn join is sent by the signal processing apparatus 11 to the yarn joining device 9, and once the yarn join has been made a signal is given to the drive motor 6 to start up the winding station.

However, if the comparison of the yarn breaks recorded in the yarn break counter 15 shows a match with the number of allowed yarn breaks predetermined by the yarn brake signal setter 16, then the signal processing apparatus 11 emits a signal through a signal line 17*a* to a feed bobbin changer 17, which thereupon exchanges the feed bobbin 2 with a new, full feed bobbin 18, because the feed properties of the feed bobbin 2 do not meet the predetermined quality.

Once the feed bobbin has been changed, a yarn join to the yarn wound onto the cheese 4 is made by the yarn joining device 9. Subsequently, the yarn is again passed to the winding apparatus 1, and the signal processing apparatus 11 gives the signal to the drive motor 6 of the winding roller 5 over the signal line 6*a*, to allow the winding station to start up again. After a change of feed bobbins, the yarn break counter 15 is set to zero The yarn break counter 15 can be set to zero under the following conditions: This is done either once a change of feed bobbins has been performed, or if the predetermined threshold value for the winding speed is exceeded, or if the number of yarn breaks permitted by the yarn break signal setter 16 is attained in an unbroken succession, below the predetermined threshold value of the winding speed. In other words, yarn breaks that occur above the predetermined threshold speed value are not recorded in the yarn break counter 15.

We claim:

1. Method for detecting feed bobbins having feed properties that do not correspond to a predetermined quality when winding feed bobbins onto cross-wound bobbins in an automatic bobbin winding machine, which comprises measuring the winding speed, counting yarn breaks before a predetermined threshold speed is reached for forming a yarn break count, detecting the quality of a given feed bobbin by comparing the yarn break count with a predetermined number and determining that the given feed bobbin has not attained a predetermined quality if the yarn break count reaches the predetermined number, and rejecting the given feed bobbin and continuing the winding process with a new feed bobbin if the predetermined quality is not attained.

2. Method according to claim 1, which comprises restarting the winding process with the given feed bobbin before carrying out the step of rejecting the feed bobbin, and rejecting the feed bobbin only if the predetermined quality is not attained after a plurality of restarting steps.

3. Method according to claim 1, which comprises forming an evaluation signal from the occurrence of multiple yarn breaks at a winding speed below the predetermined threshold speed, and utilizing the evaluation signal for determining the quality of the given feed bobbin.

4. Method according to claim 1, which comprises setting the threshold speed to a value below a normal winding speed at which a stable winding operation occurs.

5. Method according to claim 3, which comprises predetermining the threshold speed as a function of yarn parameters.

6. Method according to claim 3, which comprises predetermining the threshold speed as a function of the yarn material.

7. Method according to claim 3, which comprises predetermining the threshold speed as a function of the yarn count.

8. Winding apparatus for detecting feed bobbins having feed properties that do not correspond to a predetermined quality when winding feed bobbins onto cross-wound bobbins in automatic bobbin winding machine, comprising feed bobbin changer, a sensor for detecting winding speed and issuing a winding speed signal, a yarn monitor for ascertaining a yarn break and issuing a yarn break signal, and a signal processing apparatus connected to said yarn monitor for receiving said yarn break signal and connected to said sensor for receiving said winding speed signal and ascertaining said winding speed, signal processing apparatus being connected to said feed bobbin changer for generating and feeding a signal to said feed bobbin changer to change the feed bobbin whenever said yarn break signal and said winding speed signal at speeds up to the predetermined winding speed are present at the same time.

9. Winding apparatus for detecting feed bobbins having feed properties that do not correspond to a predetermined quality when winding feed bobbins onto cross-wound bobbins in an automatic bobbin winding machine, comprising means for measuring winding speed, means for detecting a yarn break, means connected to said detecting means for counting yarn breaks and forming a yarn break count, and means connected to said measuring means and to said counting means for comparing the yarn break count with a predetermined number and for rejecting the given feed bobbin and continuing the winding process with a new feed bobbin if the break count reaches the predetermined number.

* * * * *